US005228265A

United States Patent [19]

Arens

[11] Patent Number: 5,228,265

[45] Date of Patent: Jul. 20, 1993

[54] CARTON FORMING, PACKING AND SEALING MECHANISM INCLUDING AN INSPECTION STATION

[76] Inventor: Cornelius G. Arens, 9000 Hubbell St., Detroit, Mich. 48228

[21] Appl. No.: 943,478

[22] Filed: Sep. 11, 1992

[51] Int. Cl.[5] ..... B65B 5/08; B65B 7/26; B65B 35/12

[52] U.S. Cl. ..... 53/244; 53/245; 53/268; 53/377.6

[58] Field of Search ..... 53/235, 244, 245, 248, 53/252, 268, 377.6, 564

[56] References Cited

U.S. PATENT DOCUMENTS

| | | | |
|---|---|---|---|
| 1,403,046 | 1/1922 | Malocsay | 53/235 X |
| 1,647,356 | 11/1927 | Hendry | 53/235 X |
| 3,332,200 | 7/1967 | Englander | 53/244 X |
| 3,368,766 | 2/1968 | Livingston | 53/235 X |
| 3,842,573 | 10/1974 | Price | 53/244 X |
| 3,932,982 | 1/1976 | Klapp | 53/244 |
| 4,612,752 | 9/1986 | Deal | 53/377.6 X |

*Primary Examiner*—Horace M. Culver

[57] ABSTRACT

A carton forming, packing and sealing mechanism which includes several stations beginning with a stationary receiving platform on which components may be delivered from the continuous forming operation. A chain driven kicker is utilized to direct the components to an accumulator station. The accumulator station functions to provide a multi-planar perspective of the components as they pass thereacross. In this manner, an inspector may view the component from three discrete perspectives without changing position. Components are transferred from the accumulator station to a carton loading station. The carton loading station provides a structural nesting in which the carton may be placed. The carton loading station has a first and second position. The first position is for loading and the second position is for transferring to the gluing station. The gluing station also has a lower and upper position. The lower position is for gluing and the upper position is for holding the carton until proper adhesion of the glue has been accomplished. Once proper adhesion has been accomplished in the upper gluing station, the gluing station is lowered and a transfer nest delivers the carton to an exit platform.

20 Claims, 10 Drawing Sheets

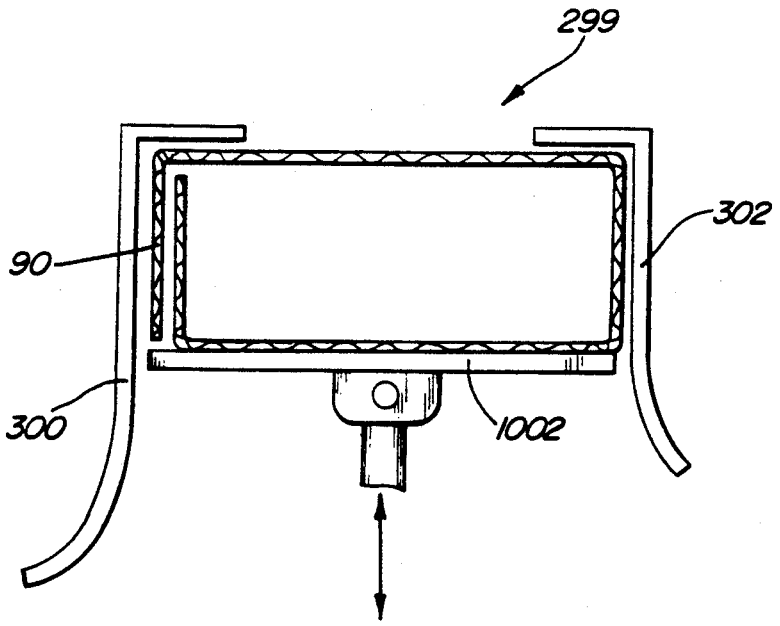
Fig-15
Fig-16
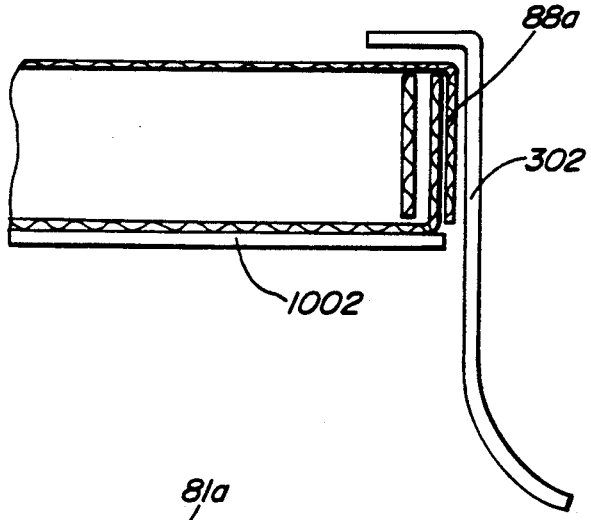
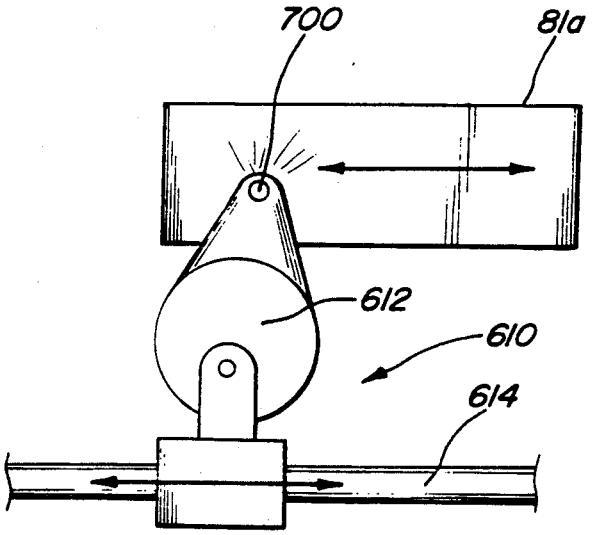
Fig-19

CARTON FORMING, PACKING AND SEALING MECHANISM INCLUDING AN INSPECTION STATION

BACKGROUND OF THE INVENTION

1. Field of the Invention

This invention relates generally to automated carton forming, packing and sealing equipment and, more specifically, to automated carton forming, packing and sealing equipment which incorporates an inspection station while occupying a minimum of square footage.

2. Description of the Prior Art

A conventional carton forming, packing and sealing operation typically involves a substantial amount of manual labor associated with forming a carton blank to define a carton structure. Once the carton structure has been established, components are manually loaded therein until the carton is filled. Once the carton has been filled, the end flaps and top are folded, glued and held until proper adhesion is achieved. Such operations require a substantial amount of manual labor and often result in a carton structure which is inferior to that which is necessary to accomplish proper containment of the components stored therein. Efforts at automating the carton packing operation involve numerous operations which typically are accomplished in various stations along a linearly proceeding line. As such, substantial square footage is required to accommodate the respective equipment. Therefore, there is a need to develop a mechanism which will minimize the labor required to form and load a carton while minimizing the required square footage occupied by the associated equipment.

In addition, the components being loaded require inspection prior to loading into the carton. This inspection is typically accomplished by an operator performing the inspection operation while viewing the parts from multiple perspectives. Multiple perspective viewing may be accomplished by moving the part or moving the inspector. In each case the operation is time consuming and requires an addition station. Therefor, there is a need for an inspection operation which may be incorporated into the carton forming, packing and sealing operation which does not require an additional operation and which minimizes inspection effort.

SUMMARY OF THE PRESENT INVENTION

The present invention comprises a carton forming, packing and sealing mechanism which includes several stations beginning with a stationary receiving platform on which components may be delivered from the continuous forming operation. A chain driven kicker is utilized to direct the components to an accumulator station. The accumulator station functions to provide a multi-planar perspective of the components as they pass thereacross. In this manner, an inspector may view the component from three discrete perspectives without changing position. Components are transferred from the accumulator station to a carton loading station. The carton loading station provides a structural nesting in which the carton may be placed. The carton loading station has a first and second position. The first position is for loading and the second position is for transferring to the gluing station. The gluing station also has a lower and upper position. The lower position is for gluing and the upper position is for holding the carton until proper adhesion of the glue has been accomplished. Once proper adhesion has been accomplished in the upper gluing station, the gluing station is lowered and a transfer nest delivers the carton to an exit platform.

These and other aspects of the present invention will become more readily apparent by reference to the following detailed description of the embodiments as shown in the drawings.

BRIEF DESCRIPTION OF THE DRAWINGS

FIG. 15 is an end view of the holding station;

FIG. 16 is a side view of the holding station;

FIG. 19 is an end view of a glue applicator utilized to apply glue to the end cap portion of the second embodiment of the present invention;

DETAILED DESCRIPTION OF THE PREFERRED EMBODIMENT

Figure 1:
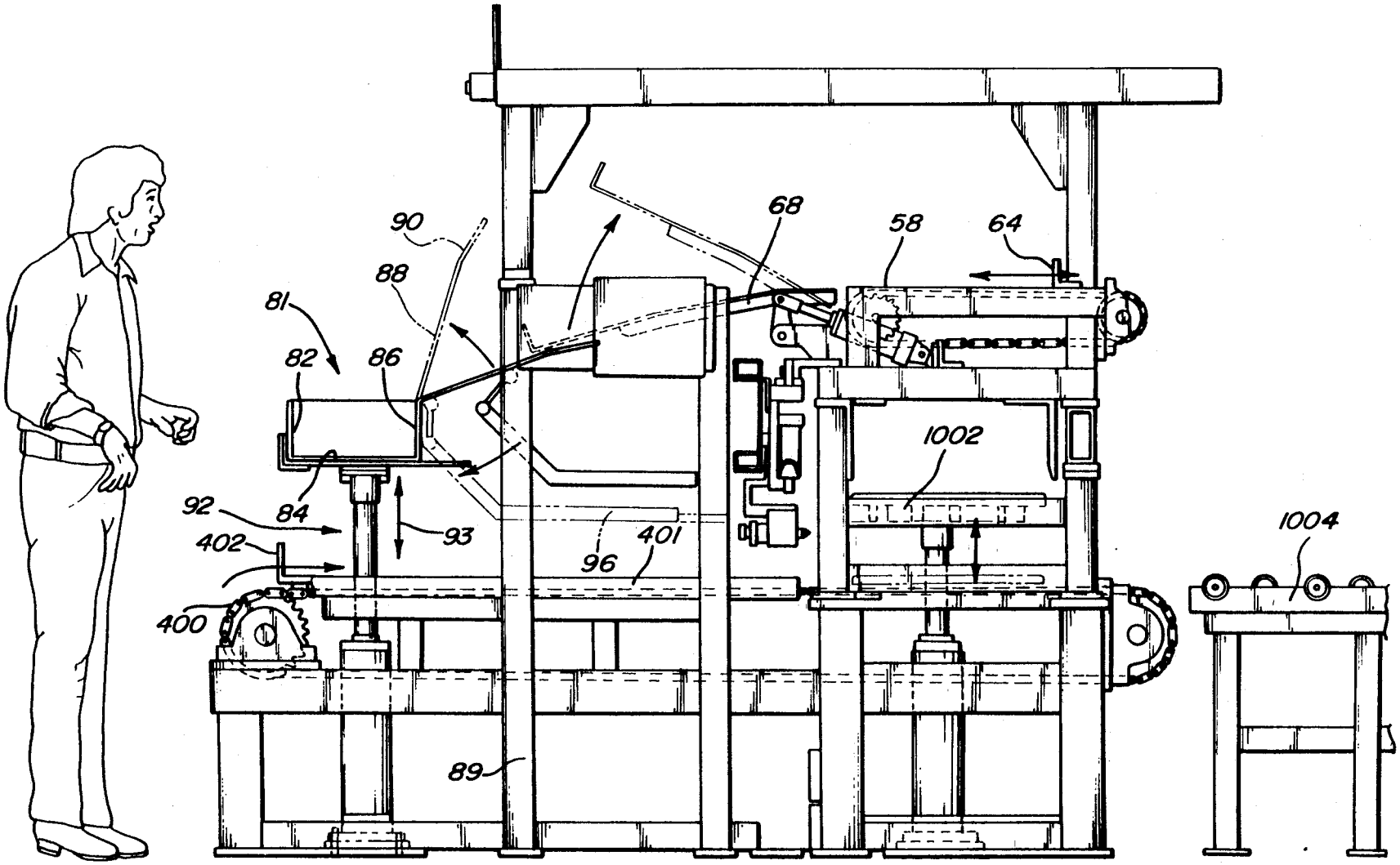
FIG. 1 is an end view of the discrete levels of various operations of the present invention.
Figure 2:
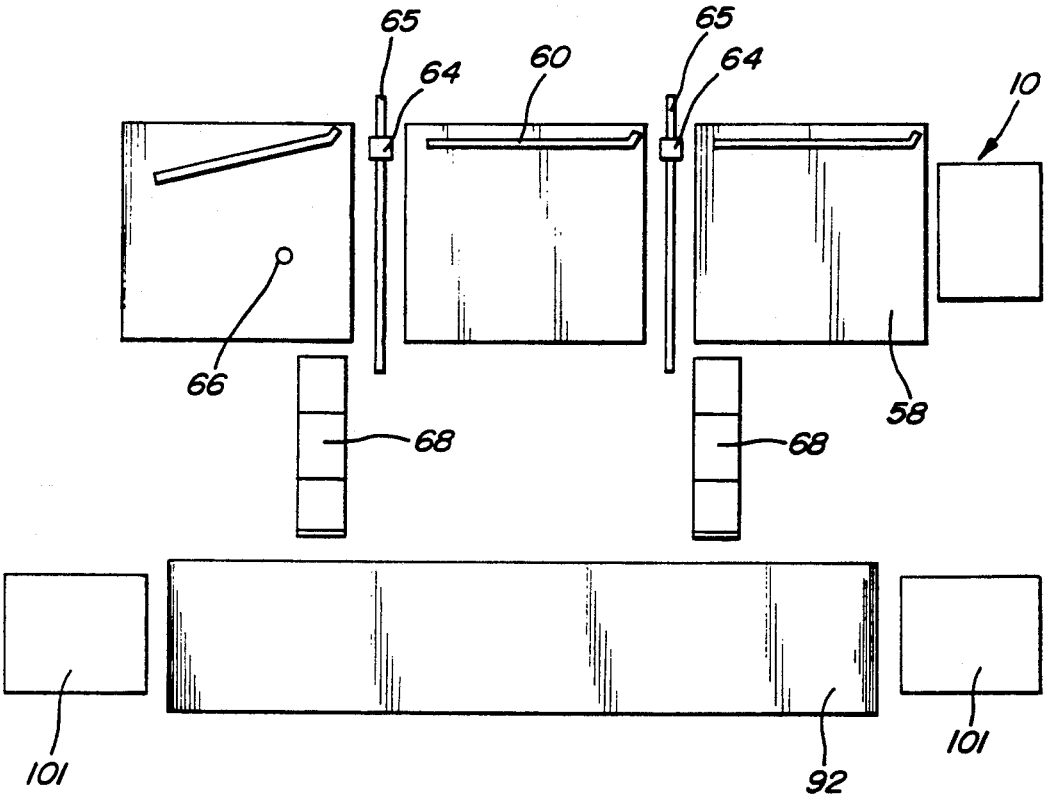
FIG. 2 is a plan view of the upper level of stations.
Figure 3:
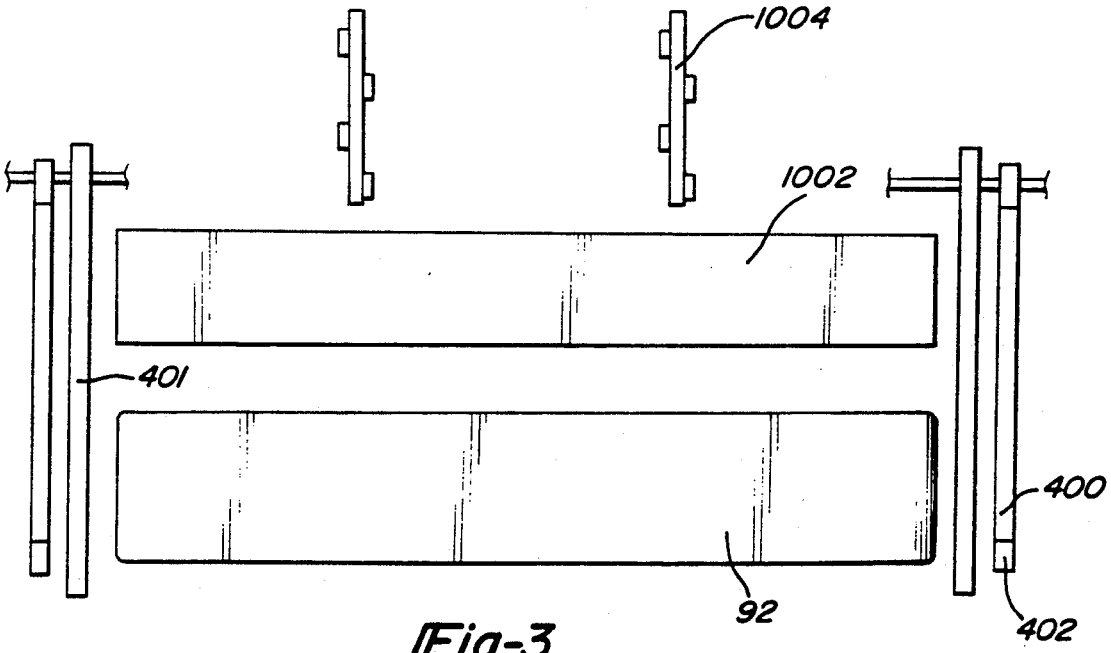
FIG. 3 is a plan view of the lower level of stations.
Figure 4:
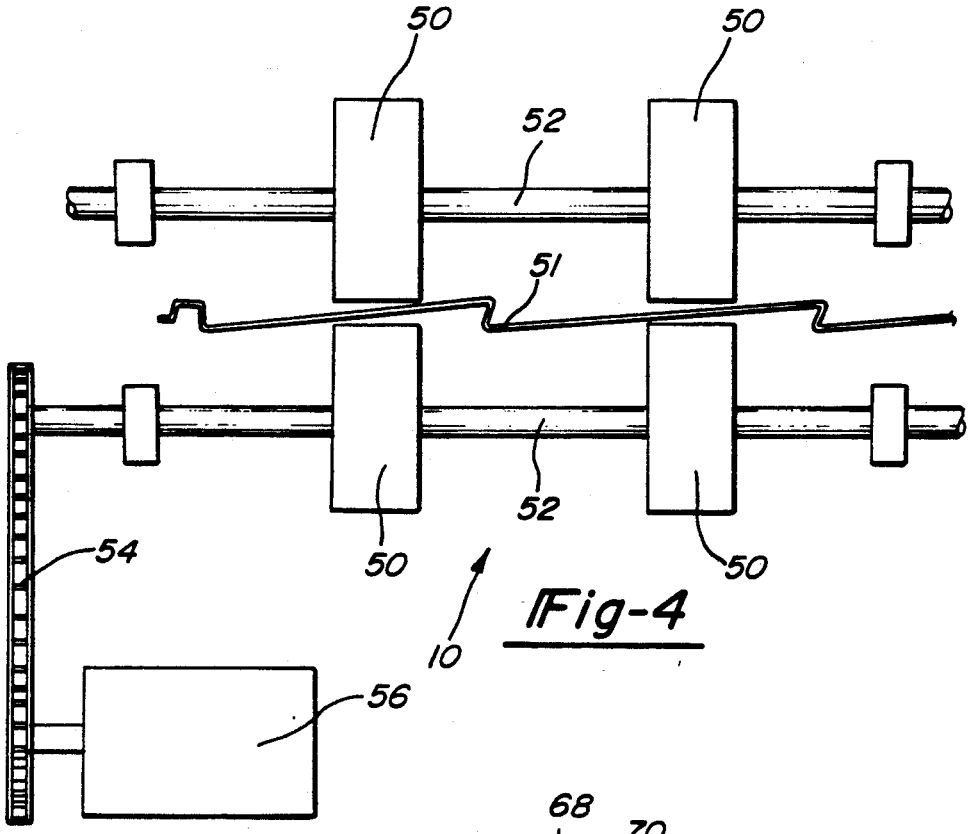
FIG. 4 is an entrance view of the feed drive mechanism.
Figure 5:
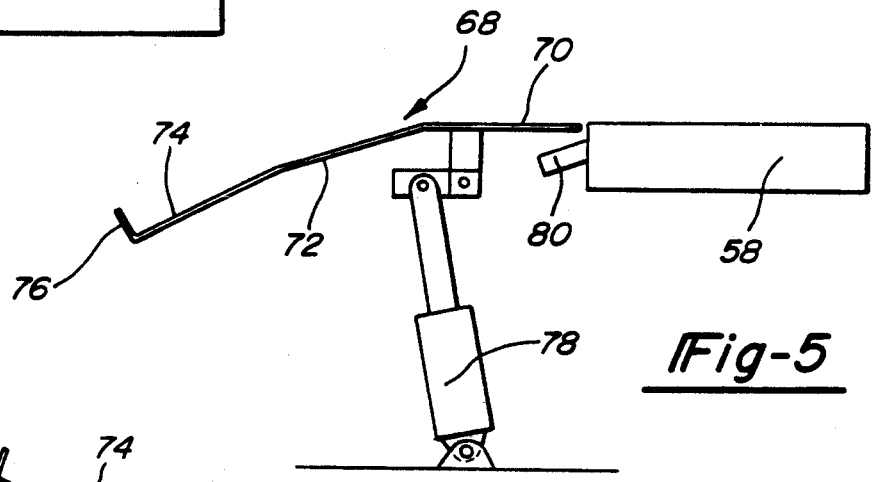
FIG. 5 is a side view of the multiplanar accumulator arm in lowered position.
Figure 6:
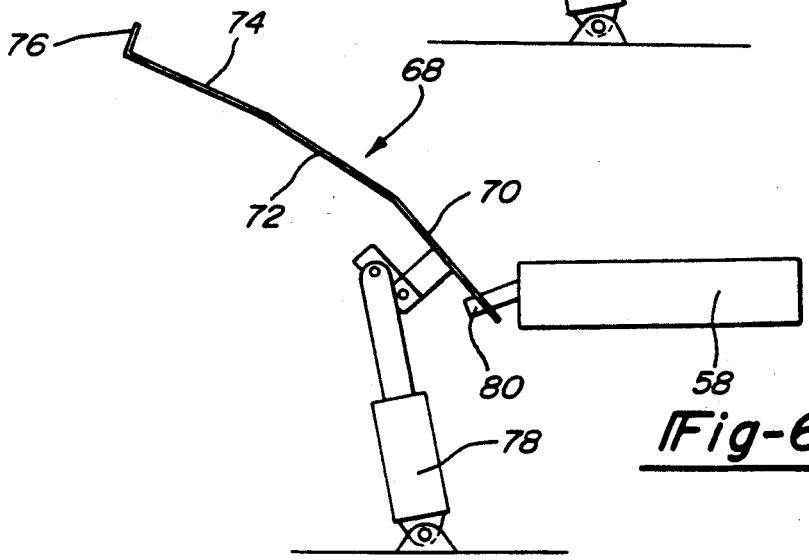
FIG. 6 is a side view of the multiplanar accumulator arm in a raised position.

The present invention incorporates several stations which occupy two several levels for receiving components, loading the respective components in a carton, gluing the carton, holding the carton until the glue sets, and depositing a completely loaded carton on an exit platform. As shown in FIGS. 1, 2 and 3, components are deposited on stationary receiving platform 58. The components are then translated onto multiplanar accumulator arm 68, 68 by kicker 64. The components are inspected by an operator as they pass over accumulator arm 68 and are then manually loaded into carton 81 positioned in carton loading station 92. Carton loading station 92 may be raised or lowered as indicated by arrow 93. Carton loading station 92 is raised for carton loading and then lowered for subsequent transfer by transfer nest 400 to glue station 1002. Glue station 1002 has a lowered position for application of glue and a raised position for retaining glued portions until the glue has set or cured. In the final operation, the carton is displaced to exit platform 1004. Feed drive 10 shown in FIG. 4 is mounted on receiving platform 58 and controls the speed at which components 51 are placed thereon. Feed drive 10 features two pairs of opposed elastically deformable wheels 50, 50 which are maintained in respective positional relationships by shafts 52, 52 one of which is shown driven by motor 56 through cain 54. Appropriate bearings may be utilized to maintain the structural relationship of the respective shafts. The wheels 50, 50 may be located and fixed on shafts 52, 52 as desired to position the wheels for engaging the respective parts fed therebetweeen. The dimensional separation between the respective shafts may also be adjusted to provide a preferred gap between opposing sets of wheels for receiving the parts and consequently providing the frictional engagement therewith as necessary to maintain a mechanical engagement between the drive wheels and components to be transferred. Motor 56 is preferably a variable speed motor which may be adjusted to suit the desired speed with which components are placed on receiving platform 58. Components exiting feed drive 10 are deposited on stationary receiving platform 58. Stationary receiving platform 58 is preferably constructed in such a manner as to present a low friction surface. In the preferred embodiment, the stationary receiving platform is constructed from stainless steel. The platform includes a part guide 60 which extends generally parallel with the stationary receiving platform structure. Structural openings in the stationary receiving platform accommodate nylon kickers 64, 64 which are driven by intermittent motion chain assembly 65. Upon detection of a part by optical sensor 66, intermittent motion chain assembly 65 cycles nylon kicker 64 to laterally displace the respective part to acumulator arm 68.

Figure 8:
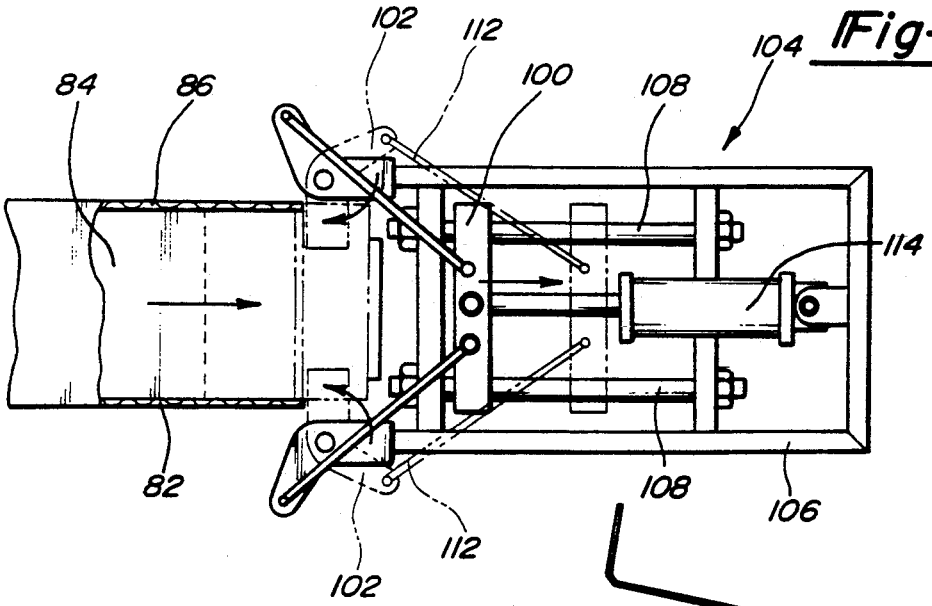
FIG. 8 is a plan view of the positive stop and end flap flipper mechanism.
Figure 9:
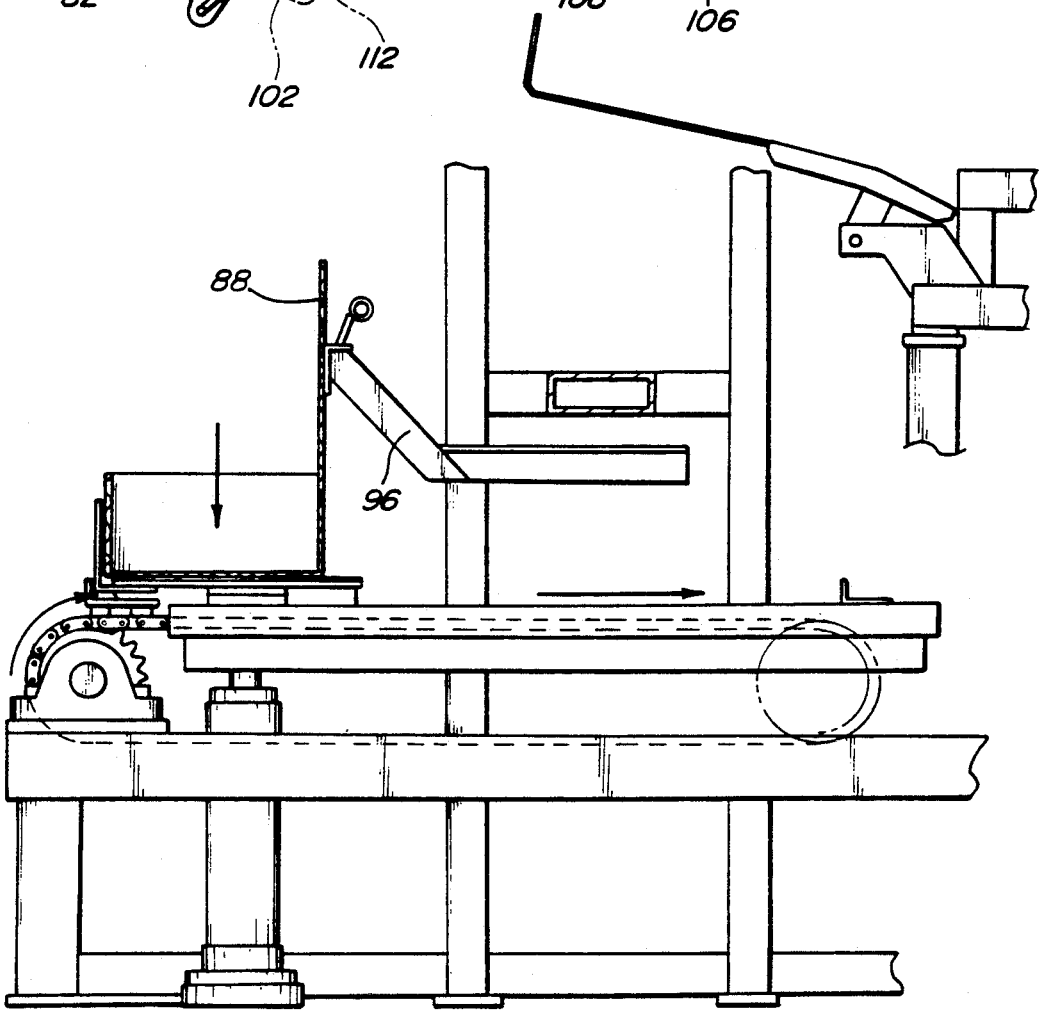
FIG. 9 is an end view of the carton loading station in a lowered position.

Accumulator arm 68 as shown in FIGS. 8 and 9 has three planar portions. A first portion 70 is generally parallel with the uppermost surface of stationary receiving platform 58 when the accumulator arm is in a lowered position. Second planar portion 72 is slightly sloped away from the first planar portion and third planar portion 74 is sloped slightly more from the second planar portion. Accumulator arm 68 includes end stop 76 which functions to trap a component which has been placed on accumulator arm 68. The first, second and third planar portions of accumulator arm 68 provide a sequentially multiplanar view of the component passing thereacross. This multiplanar view permits an inspector in inspect the component surface from three discrete perspectives without changing position. In this manner an inspector with a minimum of movement may observe three planar views of the component and thereby assess the quality of the surface finish present thereon. The accumulator arm 68 includes an air cylinder 78 which may be used to raise the accumulator arm 68 to an upper position as shown in FIG. 9. In this position, a positive stop 80 secured to the stationary receiving platform 58 will prevent any components remaining on the accumulator arm 68 from sliding therethrough.

Figure 7:
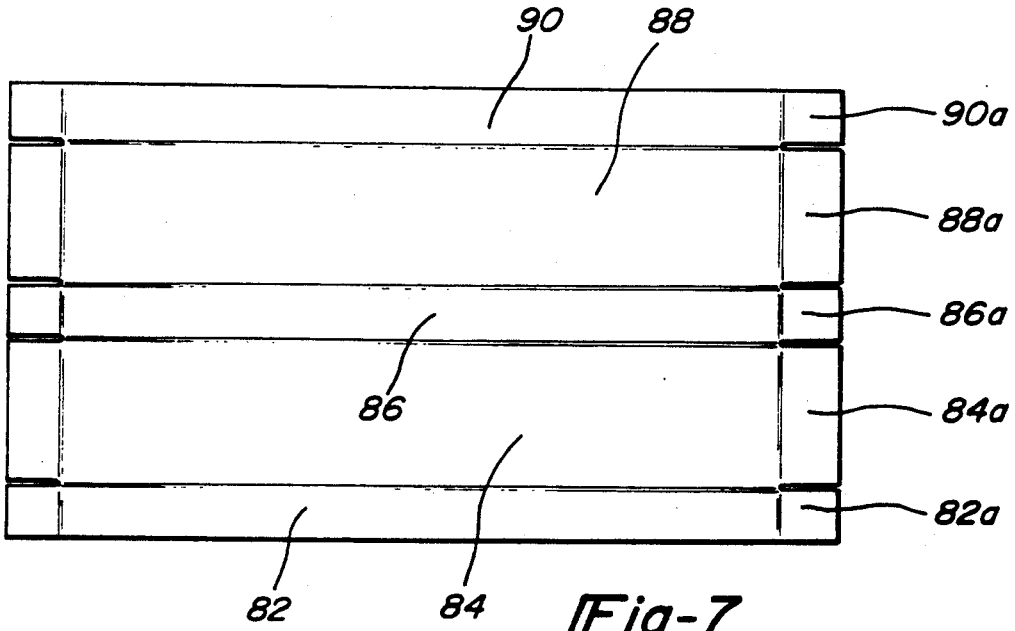
FIG. 7 is a plan view of a carton blank to be formed packed and sealed.

In operation, a carton as shown in blank form in FIG. 7, having a front inside lip 82, a bottom 84, a back 86 top 88 and a front outside lip 90 may be inserted into carton loading station 92, shown in FIG. 1. Carton loading station 92 includes a first angle portion 94 in which the front inside lip 82 and bottom 84 are nestably received. A folding guide bar 96 contacts the back 86 thereby accomplishing definition of three structurally supported sides for carton 81. During installation of the carton, accumulator arm 68 is maintained in the upward position. After the carton has been nestably received in carton loading station 92, accumulator arm 68 is lowered thereby contacting carton top 88 and defining a crease between back 86 and top 88. Cylinder 89 is used to position carton loading station 92 in raised or lowered position.

In addition to the nesting relation between box 81 and first angle portion 94 and folding guide bar 96, the box is centered by engagement of opposing bottom end portion 84A with opposing positive stop 99 incorporated in the end flap flipper mechanism 104, as shown in FIG. 8. End flap flipper mechanism 104 includes a frame 106 which provides structural support for guide bars 108, 108 to facilitate reciprocation of slide 100. Arms 112, 112 connect slide 100 to flippers 102, 102. Cylinder 114 produces the motive force to reciprocate slide 100. After box 81 has been nested in carton loading station 92, front inside lip end flap 82A and back end flap 86A are creased to a position 90° from that existing in blank form by opposing flippers 102,102. The flippers are maintained in this position thereby supporting the ends of the carton so as to define a structure having five sides and an open top.

Figure 14:
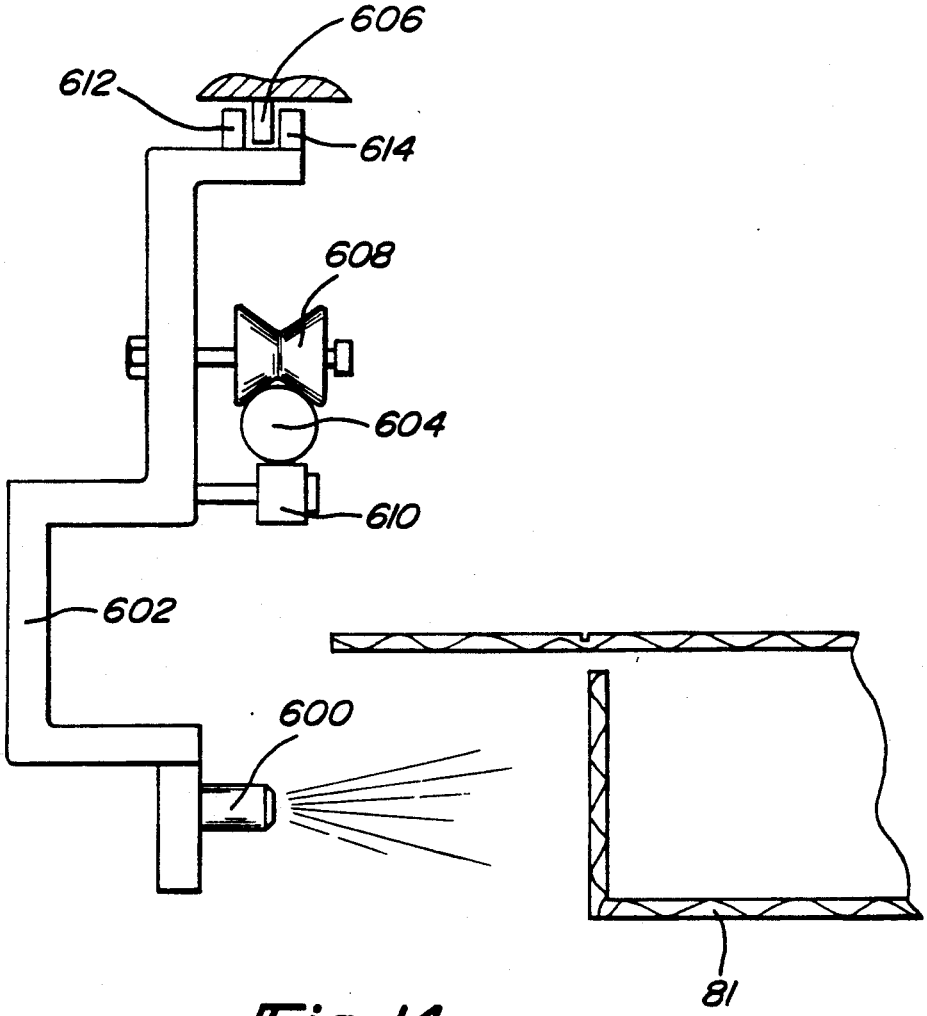
FIG. 14 is an end view of the translating glue application.
Figure 10:
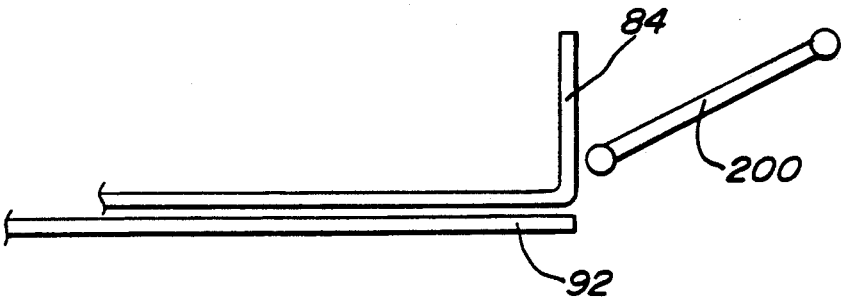
FIG. 10 is an end view of the carton loading station showing a carton having the rear panel formed 90° to the bottom by a guide bar.
Figure 11:
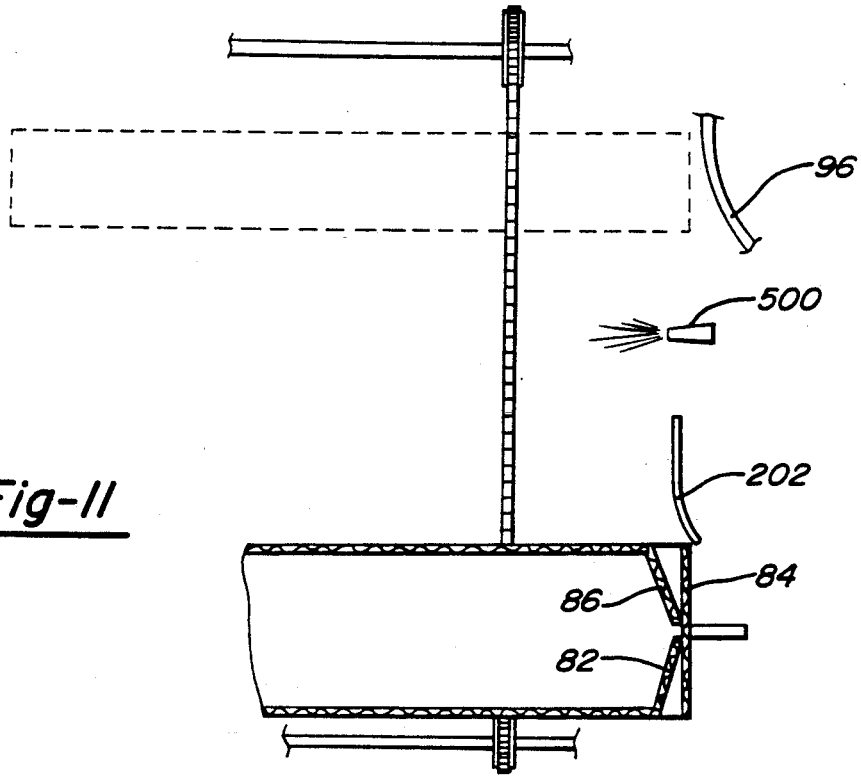
FIG. 11 is a plan view of a carton transfer along the lower level through guide bars.
Figure 12:
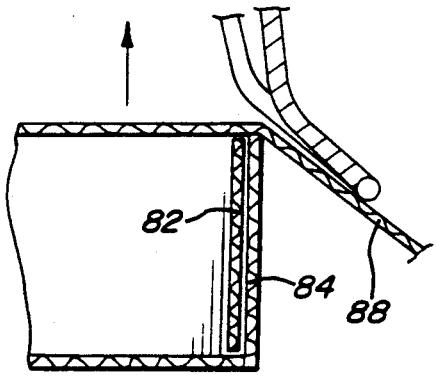
FIG. 12 is a front view of a carton passing a guide bar.
Figure 13:
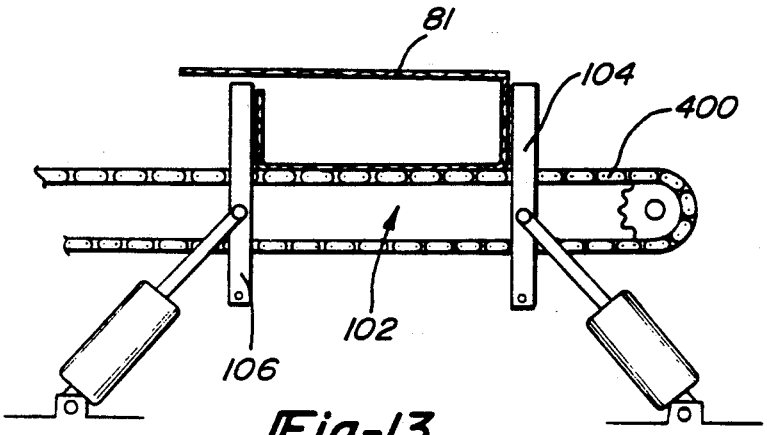
FIG. 13 is an end view of the centering arms of the gluing station.
Figure 20:
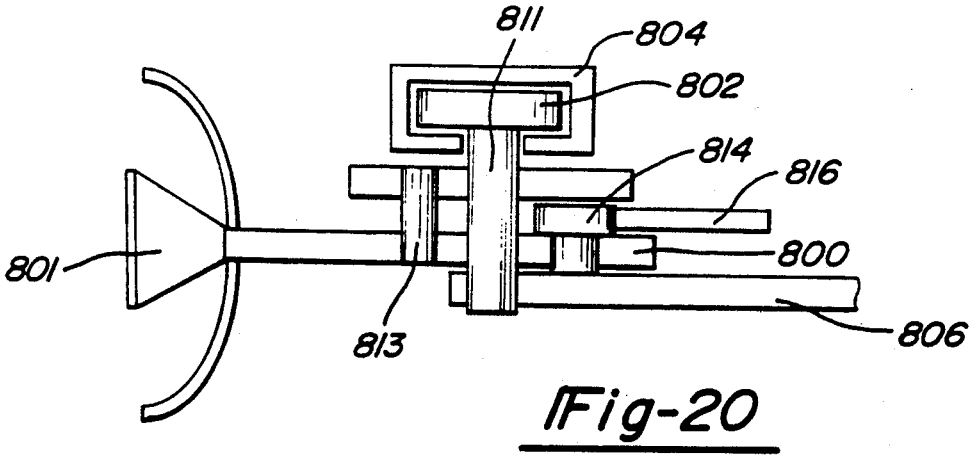
FIG. 20 is a top view of the end cap lift and pivot mechanism.

After carton 81 has been properly positioned in carton loading station 92, components are delivered to accumulator arm 68 and then manually loaded into carton 81. When carton 81 is full, carton loading station 92 is lowered by releasing air stored in cylinder 89. Coincidentally, accumulator arm 68 is raised and flipper arms 102, 102 are retracted. As carton loading station 92 is lowered, carton top 88 is drawn across folding guide bar 96, shown in FIG. 9, thereby deflecting top 88 to an upwardly oriented position. In addition, as carton loading station 92 is lowered, bottom end flaps 84A are drawn across guide bar 200, shown in FIG. 10. When carton loading station 92 reaches the lowered position, transfer nest 400 engages carton 81 displacing carton 81 rearward. As carton 81 is translated from carton loading station 92 rearward, end flap retaining guide bar 202, as shown in FIG. 11, maintains the front inside end flap 82A, back end flap 86A and bottom end flap 84A in a creased position. As carton 81 is moved rearward, top end flap guide bar 96, shown in FIGS. 11 and 12, begins to displace top end flap 88A achieving partial positioning for subsequent completion of the folding operation. Intermediate the transfer of carton 81 from the carton loading station 92 to the gluing station 1002 an adhesive is applied to the outermost surface of the bottom end flap 84A. The adhesive is applied by spray applicator 500 that includes a proximity sensor (not shown) which detects the presence of passing carton 81. Once carton 81 reaches gluing station 102, transfer nest 400 translation is interrupted. Next, two rear 104 and thre forward 106 centering arms, as shown in FIG. 13, engage carton 81 and effect centering thereof in gluing station 1002. At this point glue is applied to the peripheral surface of the front inside lip by translating glue applicator device 600 as shown in FIG. 14. Translating glue applicator device 600 is secured to a frame 602 which is guided by a pair of respectively positioned guide bars 604, 606. Opposing guide followers 608, 610 and 612 act to maintain the lateral position of the applicator throughout translation thereof. Next, carton 81 while in the glue station 102 is raised into a holding station 299, as shown in FIG. 15, where the front outside flap 90 is folded into engagement with respective carton portions by a front outside folding guide 300. Top end flap folding guide 302 folds top end flap 88A into engagement with respective carton portions, as shown in FIG. 16. Once in holding station 299, carton 81 is completely nested between gluing station platform 1002 and front outside folding guide 300 and top end flap folding guide 302. Carton 81 is maintained in holding station 299 for a predetermined period of time until the glue has achieved a bond between respective portions of carton 81. Next, front and rear centering arms 104, 106 are retracted, carton 82 is returned to gluing station 102 and transfer nest 400 is actuated to move carton 81 to exit platform 1004.

Figure 17:
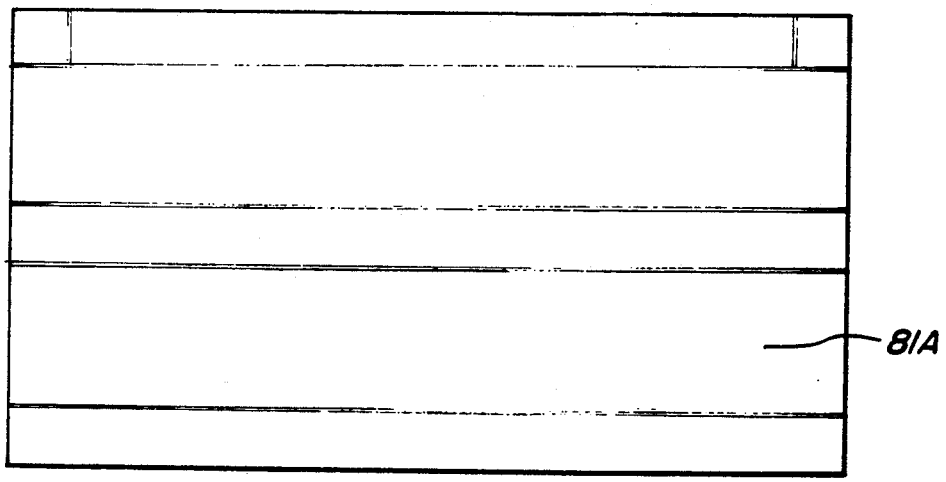
FIG. 17 is a plan view of the carton utilized in the second embodiment of the present invention.
Figure 18:
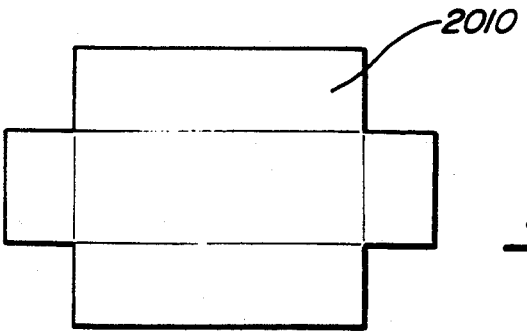
FIG. 18 is a plan view of the end cap utilized in the second embodiment.
Figure 21:
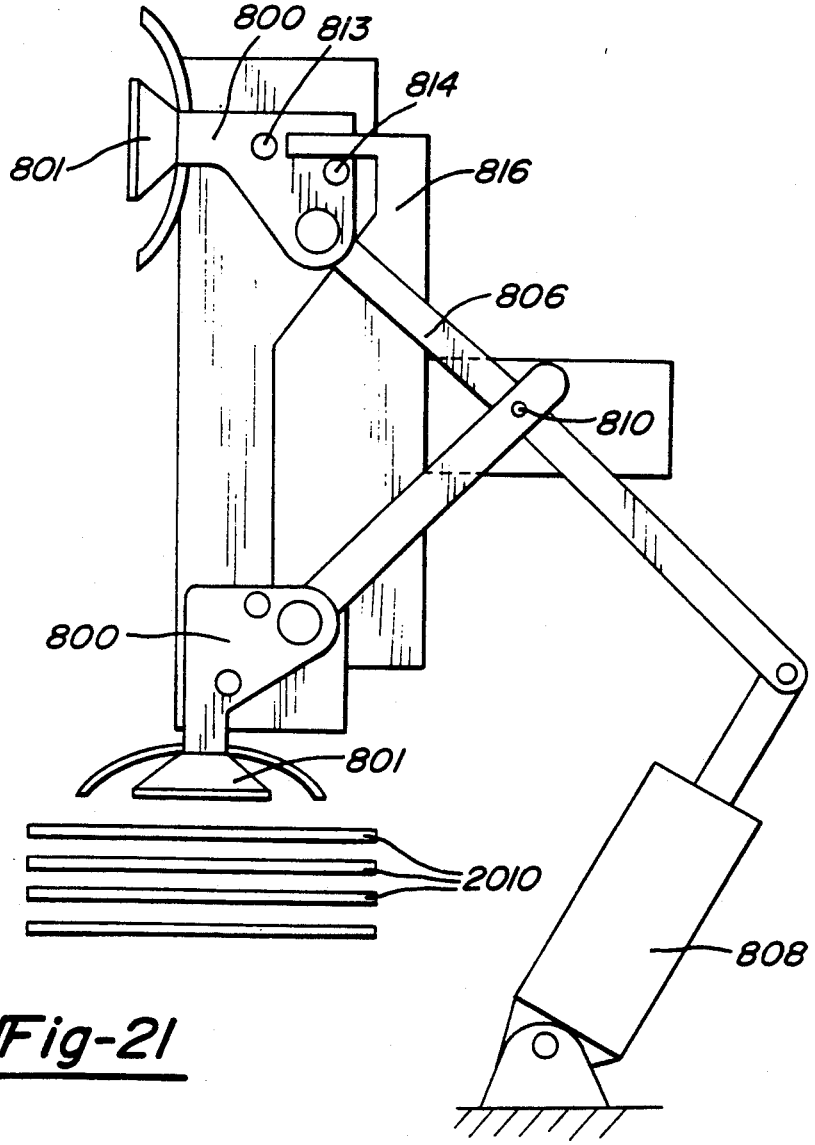
FIG. 21 is a side view of the end cap lift and pivot mechanism in raised position.
Figure 22:
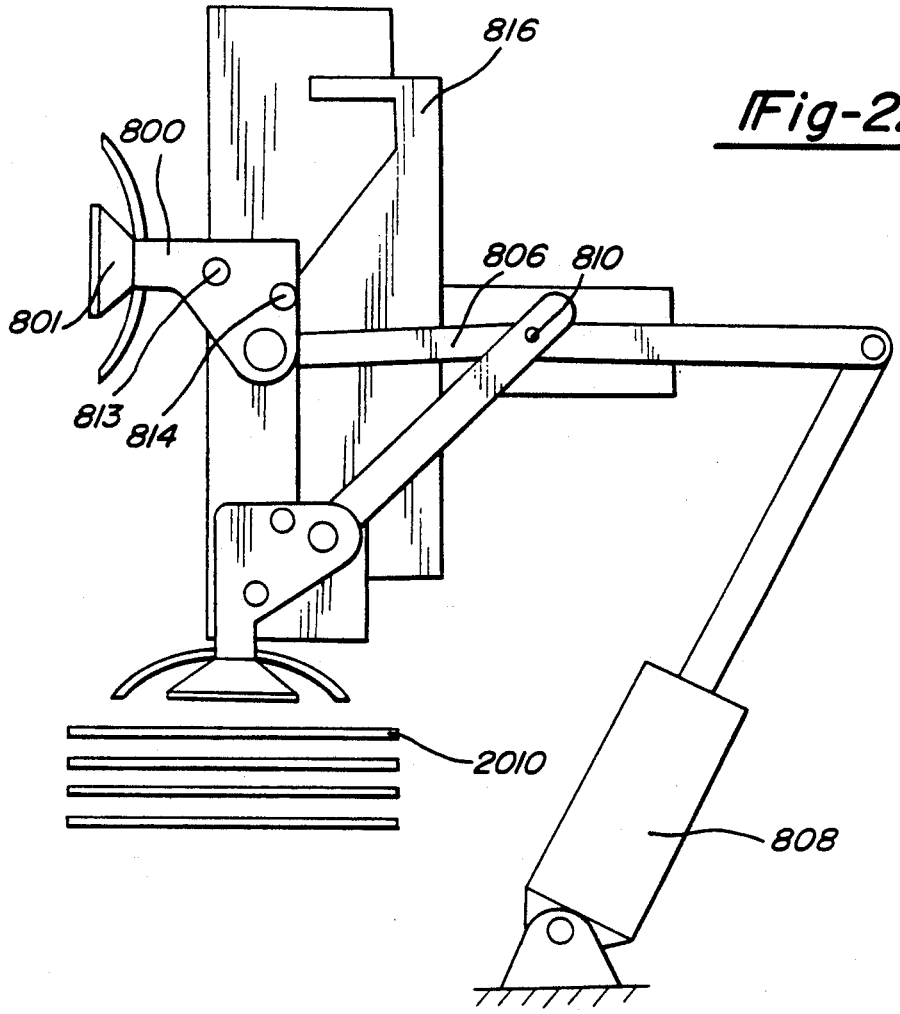
FIG. 22 is a side view of the end cap lift and pivot mechanism in lowered position.
Figure 23:
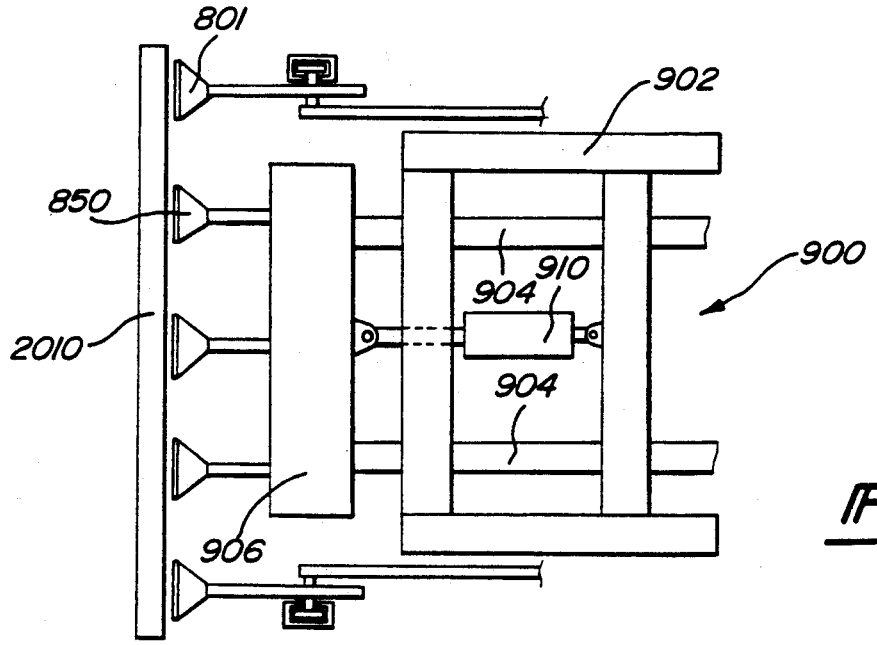
FIG. 23 is a plan view of the end cap installation mechanism.

In a second embodiment the carton, as shown in FIGS. 17 and 18, carton 81A has separate end caps 2010. To convert the previously described equipment to one capable of processing cartons having end caps, end flap guides must be removed and the flippers 102, 102 must be maintained in a retracted position. All other nesting and creasing operations remain the same. As before, the top 88 is folded to complete four sides of the carton as the carton is transferred from carton loading station 92 to gluing station 1002. In gluing station 1002 while the previously described glue applicator 600 is traversing, glue applicator 700, shown in FIG. 19, is extended laterally into the open ends of carton 81A and rotated to apply glue to the inside surface of the carton. Glue applicator 700 passes through a path which provides a uniform application of glue to the inside surface of carton 81. Glue applicator 700 is carried by rotary motion control device 610 which includes an oscillator 612 for providing a first 180° rotation of glue applicator 700 at which point rotary motion control device 612 is translated along guide bar 614 by an air cylinder (not shown). When the limit of translation is achieved, device 612 completes another 180° of rotation. Finally, device 612 is returned to initial position by retracting the air cylinder. When the initial position is reached, oscillator 612 reverses to uncoil the hose delivering glue to applicator 700. After glue has been applied, carton 81 is raised to hold station 299 where an end cap 2010 is installed. As shown in FIGS. 20, 21, 22 and 23, end caps 2010 are stacked and individually picked up by suction cup 801 which is located on pivoting head 800 carried by slide block 802, as shown in FIG. 21. Slide block 802 reciprocates in guide 804 by operation of link 806 driven by cylinder 808. Link 806 rotates through an arc defined by pin 810. Head 800 is secured to slide block 802 by slider pin 811. Cam follower 814 interacts with cam profile 816 to define the pivoted position of head 800. In operation, with cylinder 808 retracted, cam follower 814 is engaging a fixed positive stop portion of cam profile 816. Upon initial extension of cylinder 808, cam follower 814 is free to pass into the recessed portion 815 of cam 816. This rotation is facilitated by the leftward position of the center of gravity of head 800 with respect to pivot 813 (as shown in FIG. 21). Upon subsequent displacement of cylinder 808, cam follower 814 traverses the 45° portion of cam profile 816 causing the head to pivot a full 90°. Slide block 802 then passes down guide 804 until end caps 2001 are contacted. A vacuum will build until cup 801 is deformed and frame portion 803 contacts end cap 2010. At this point, cylinder 808 is retracted returning head 800 to initial position. During the retraction, cam follower 814 strikes the positive stop portion of cam profile 816 and head 800 rotates 90°. Next, an additional set of vacuum cups 850 are indexed into engagement with end cap 2010 and vacuum is applied thereto. When the vacuum has reached sufficient strength to hold end cap 2010, the vacuum in cup 801 is released. End cap 2010 may then be transferred laterally by assembly 900; shown in FIG. 23, until the end cap 2010 reaches the proper installed position in carton 81. Assembly 900 includes frame 902 adapted to receive reciprocating guide bars 904 and head 906. Vacuum cups 850 are thus extended and retracted by operation of air cylinder 910. After the end cap 2010 is properly positioned in the carton, the vacuum is removed, from cup 850 and the cups are retracted. The carton is maintained in the glue holding station until proper adhesion is realized at which point the carton may proceed according to the operations previously described.

One skilled in the art will readily recognize that certain specific details shown in the foregoing specification and drawings are exemplary in nature and subject to modification without departing from the teachings of the disclosure. Various modifications of the invention discussed in the foregoing description will become apparent to those skilled in the art. All such variations that basically rely on the teachings through which the invention has advanced the art are properly considered within the spirit and scope of the invention.

I claim:

1. An apparatus for forming, packing and sealing a carton comprising:

a first platform oriented to receive components disposed thereon in a first direction;

means for displacing said components from said first platform in a direction orthogonal to said first direction to a multiplanar platform including a plurality of increasingly sloped surfaces;

a second platform providing a structure oriented to nestably receive a carton blank disposed therein so as to form a carton;

said carton including a front inside lip, bottom, back, top and front outside lip;

means to selectively elevate said second platform between a lowered position and a raised position;

means for transferring components from said multiplanar platform to a carton nestably received in said second platform disposed in said raised position;

means to transfer said carton form said second platform disposed in said lowered position to a third platform;

means to selectively elevate said third platform between a lowered position and a raised position;

means to apply glue to said front inside lip and raise said third platform to position said carton in a holding mechanism; and means to transfer said carton to a fourth platform.

2. The invention of claim 1 wherein said means for displacing components from said first platform is a transfer nest.

3. The invention of claim 1 wherein said transfer nest is cycled upon detection of a component disposed on said first platform.

4. The invention of claim 1 wherein said platform further includes a guide which deflects said components to prevent said components from passing over said first platform.

5. The invention of claim 1 wherein said multiplanar platform includes a first, second and third planar portion each having an increasingly greater slope.

6. The invention of claim 1 wherein said multiplanar platform pivots about a first end to provide access to nestably received a carton blank in said second platform.

7. The invention of claim 1 wherein said carton top is deflected to a partially closed position by a folding guide bar as said second platform is moved from said raised to said lowered position.

8. The invention of claim 1 wherein said carton top is deflected to a closed position by a folding guide bar as said carton is transferred from said second platform disposed in said lowered position to said third platform.

9. The invention of claim 1 wherein said means to transfer said carton from said second platform disposed in said lowered position to a third platform is a transfer nest.

10. The invention of claim 1 wherein said means to apply glue to said front inside lip includes a traversing glue applicator directed at said front inside lip of said carton disposed in said third platform in said lowered position.

11. The invention of claim 1 wherein said carton further includes front inside lip end flaps, bottom end flaps, back end flaps, top end flaps and front outside lip end flaps.

12. The invention of claim 11 wherein said bottom end flaps are deflected to closed position by a guide bar as said second platform is moved to said lowered position.

13. The invention of claim 11 wherein said front inside lip end flaps and said back end flap are deflected to closed position by opposed flipper arms.

14. The invention of claim 11 wherein said bottom end flap, said front inside end flap are maintained in closed position during transfer from said second platform to said third platform by a folding guide bar.

15. The invention of claim 11 wherein said top end flap is partially folded to a closed position by a folding guide bar as said carton is transferred from said second platform to said third platform.

16. The invention of claim 11 wherein said top end flap is secured to said bottom end flap by adhesive applied as said carton is transferred from said second platform to said third platform.

17. The invention of claim 1 including means for raising end caps from a first stacked position, pivoting them to a second position orthogonal to said first and then indexed laterally into said carton disposed on said third platform in raised position.

18. The invention of claim 17 wherein said end caps are held by vacuum cups disposed on a pivoting head that is reciprocated along a vertically oriented path, said pivoting head having a predefined pivoted position which corresponds to a position on said vertically oriented path which is defined by the interaction of a cam follower disposed on said head and a cam profile disposed along said vertically oriented path.

19. An apparatus forming, packing and sealing a carton comprising:

a first platform oriented to receive components disposed thereon in a first direction;

a first transfer nest disposed on said first platform for displacing said components in a direction orthogonal to said first direction upon detection thereof;

a multiplanar platform disposed adjacent said first platform for receiving components transferred therefrom and offering a multiplanar view thereof as said components pass thereacross;

a second platform providing a first and second orthogonally disposed surface oriented to nestably receive a carton blank disposed thereon so as to form a partial carton;

said carton including a front inside lip having end flaps disposed from opposing ends, a bottom having end flaps disposed from opposing ends, a back having end flaps disposed from opposing ends, a top having end flaps disposed from opposing ends and a front outside lip;

said second platform having a selectable elevated position between a lowered and raised position achieved by a fluid actuated cylinder;

means for transferring components from said multiplanar platform to a carton nestably received on said second platform disposed in said raised position;

an opposed pair of end flap flippers which deflect said front inside lip and said back inside lip to closed position while said second platform is in said raised position;

a second transfer nest disposed in relation to said second platform for transferring said carton from said second platform disposed in said lowered position to a third platform;

guide bars disposed for closing said bottom and top end flaps as said carton is transferred from said second platform disposed in said lowered position to said third platform;

said third platform having a selectable elevated position between a lowered and raised position achieved by a fluid actuated cylinder applicators to apply glue to said front inside lip while said carton is disposed on said third platform;

guide bars disposed for closing and holding said carton while on said third platform disposed in a raised position until said glue achieves a bond;

means for raising end caps from a first stacked position, pivoting them to a second position orthogonal to said first and then indexed laterally into said carton disposed on said third platform in raised position; and a fourth platform to which said second transfer nest transfers said carton upon completion of glue bond and subsequent displacement of said third platform to a lowered position.

20. An apparatus for forming, packing and sealing a carton comprising;

a first platform oriented to receive components disposed thereon in a first direction;

a first transfer nest disposed on said first platform for displacing said components in a direction orthogonal to said first direction upon detection thereof;

a multiplanar platform disposed adjacent said first platform for receiving components transferred therefrom and offering a multiplanar view thereof as said components pass thereacross;

a second platform providing a first and second orthogonally disposed surface oriented to nestably receive a carton blank disposed thereon so as to form a partial carton;

said carton including a front inside lip, bottom; back, top and front outside lip;

said second platform having a selectable elevated position between a lowered and raised position achieved by a fluid actuated cylinder;

means for transferring components from said multiplanar platform to a carton nestably received on said second platform disposed in said raised position;

a second transfer nest disposed in relation to said second platform for transferring said carton from said second platform disposed in said lower position to a third platform;

said third platform having a selectable elevated position between a lowered and raised position achieved by a fluid actuated cylinder and applicators to apply glue to said front inside lip while said carton is disposed on said third platform;

guide bars disposed for closing and holding said carton while on said third platform disposed in a raised position until said glue achieves a bond;

a fourth platform to which said second transfer nest transfers said carton upon completion of glue bond and subsequent displacement of said third platform to a lowered position; and means for raising end caps form a first stacked position, pivoting them to a second position orthogonal to said first and then indexed laterally into said carton disposed on said third platform in raised position.

* * * * *